US006908001B2

(12) United States Patent
Moore

(10) Patent No.: US 6,908,001 B2
(45) Date of Patent: Jun. 21, 2005

(54) NARROW PULL TAB

(75) Inventor: David N. Moore, Plainfield, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

(21) Appl. No.: 10/301,204

(22) Filed: Nov. 21, 2002

(65) Prior Publication Data

US 2004/0099630 A1 May 27, 2004

(51) Int. Cl.[7] ..... B65D 53/00
(52) U.S. Cl. ..... 215/349; 220/359.2
(58) Field of Search ..... 215/232, 349, 215/341, 343, 344, 347, 363, 364, 326, 327; 220/359.1–359.5, 276, 258.3–258.5

(56) References Cited

U.S. PATENT DOCUMENTS

| | | | | |
|---|---|---|---|---|
| 3,391,847 A | | 7/1968 | Christine et al. | 229/43 |
| 3,900,125 A | | 8/1975 | Wyler et al. | 215/341 |
| 3,973,719 A | | 8/1976 | Johnson et al. | 229/5.6 |
| 4,438,850 A | | 3/1984 | Kahn | 206/634 |
| 4,588,099 A | | 5/1986 | Diez | 215/232 |
| 4,693,390 A | | 9/1987 | Hekal | 220/359 |
| 4,697,719 A | | 10/1987 | Allen | 220/258 |
| 4,722,447 A | | 2/1988 | Crisci | 215/232 |
| 4,778,698 A | | 10/1988 | Ou-Yang | 428/35 |
| 4,784,885 A | | 11/1988 | Carespodi | 428/36.8 |
| 4,872,571 A | | 10/1989 | Crecelius et al. | 215/232 |
| 4,927,065 A | | 5/1990 | Beck | 222/520 |
| 4,930,646 A | | 6/1990 | Emslander | 215/232 |
| 4,934,544 A | | 6/1990 | Han et al. | 215/232 |
| 4,981,229 A | | 1/1991 | Lanham | 215/232 |
| 5,012,946 A | | 5/1991 | McCarthy | 220/258 |
| 5,129,531 A | | 7/1992 | Beck et al. | 215/256 |
| 5,176,271 A | | 1/1993 | Painchaud et al. | 215/261 |
| 5,197,618 A | | 3/1993 | Goth | 215/232 |
| 5,215,204 A | | 6/1993 | Beck et al. | 215/252 |
| 5,297,688 A | | 3/1994 | Beck et al. | 215/344 |
| 5,372,268 A | * | 12/1994 | Han | 215/232 |
| 5,511,679 A | | 4/1996 | Beck | 220/270 |
| 5,579,943 A | | 12/1996 | Johnson | 220/258 |
| 5,664,694 A | * | 9/1997 | Bietzer et al. | 215/256 |
| 5,797,509 A | | 8/1998 | Fitch | 220/258 |
| 5,829,609 A | | 11/1998 | Beck | 215/217 |
| 5,842,592 A | | 12/1998 | Beck | 215/253 |
| 5,927,530 A | | 7/1999 | Moore | 215/232 |
| D435,793 S | | 1/2001 | Kreiseder | D9/449 |
| 6,174,274 B1 | * | 1/2001 | Hawkins et al. | 493/77 |

* cited by examiner

*Primary Examiner*—Lien M. Ngo
(74) *Attorney, Agent, or Firm*—Brian J. Sodikoff, Esq.; Welsh & Katz, Ltd.

(57) ABSTRACT

A container and closure assembly whereby a pull tab sufficiently narrow in width is secured to the interior of the closure, thereby preventing the closure from becoming loosened or displaced, yet when sufficient torque is applied by the consumer to open the closure and remove it from the container the narrow pull tab is disengaged from its seal to the interior of the closure, yet having the liner over the mouth of the closure remains intact and undamaged, thus preventing any contamination of the container content.

18 Claims, 3 Drawing Sheets

NARROW PULL TAB

BACKGROUND OF THE INVENTION

The present invention relates to an innerseal or liner of a container, which is used for sealing and securing the contents of a container. More particularly, the invention relates to an improved innerseal or liner, for a container, which not only effectively protects the contents of a container during transport and storage, but also secures the closure of the container and prevents the closure from being displaced from the container during transport and storage.

Containers for dispensing consumer products such as food, drugs, etc., which utilize twist or snap cap closures, are typically sealed to prevent against tampering until the product safely reaches the consumer, ensuring that the materials in the container are tamper and contamination free. Consequently, the need for protection and safety of products that are packaged and delivered for use and consumption has required the need for tamper evident membranes, which seal the mouth of a container and are used in conjunction with a closure and container. Many advantages have been made to these innerseals, which provide safer and more effective sealing means, such as allowing for resealing, easier facilitation for opening and tamper evident bands. These and other advantages allow for easier access and more protection for the consumer.

In many instances, however, during transport and distribution of materials in containers, closures often are loosened. Not only can this loosening or displacement of a closure make a consumer hesitant to purchase a product due to safety and contamination concerns, but this also allows for the liner to be unnecessarily exposed to the environment and be prone to accidental or malicious tampering. Moreover, products with loose closures may be passed up by consumers even if the container liner is intact, and may eventually have to be discarded. This problem will not only lead to higher costs for the manufacturing due to its products being needlessly discarded, but this also allows for a higher chance of damage to the seal and the contents of the container.

Therefore, there exists a need to provide a secure container and closure that prevents against loosening of the closure during transport and delivery of products.

SUMMARY OF THE INVENTION

A feature of the present invention is to provide an innerseal or liner for a container having a tamper resistant sealing membrane including a narrow pull tab or extension. This sealing membrane or liner secures itself over the mouth of a container preventing access to the contents, and providing a seal, while at the same time ensuring a tamper and contaminate free product. The narrow pull tab or extension is secured to the closure of the container and prevents the closure from becoming displaced or loose on the container during transport and delivery, thus unnecessarily exposing the seal.

Another feature of the present invention is providing a pull tab or extension which is sufficiently narrow so that torque applied by the average consumer is sufficient to permit the consumer to open the container assembly, while not damaging the liner and the seal between the liner and the container, thus, protecting the contents of the container even after the initial removal of the closure, allowing the liner to be pulled to open when desired.

Yet another feature of the present invention is providing a method of securing closures to prevent loosening during transport.

These and other features and advantages of the present invention will be apparent from the following detailed description, in conjunction with the appended claims.

BRIEF DESCRIPTION OF DRAWINGS

The benefits and advantages of the present invention will become more readily apparent to those of ordinary skill in the relevant art after reviewing the following detailed description and accompanying drawings, wherein.

DETAILED DESCRIPTION OF DRAWINGS

Figure 1:
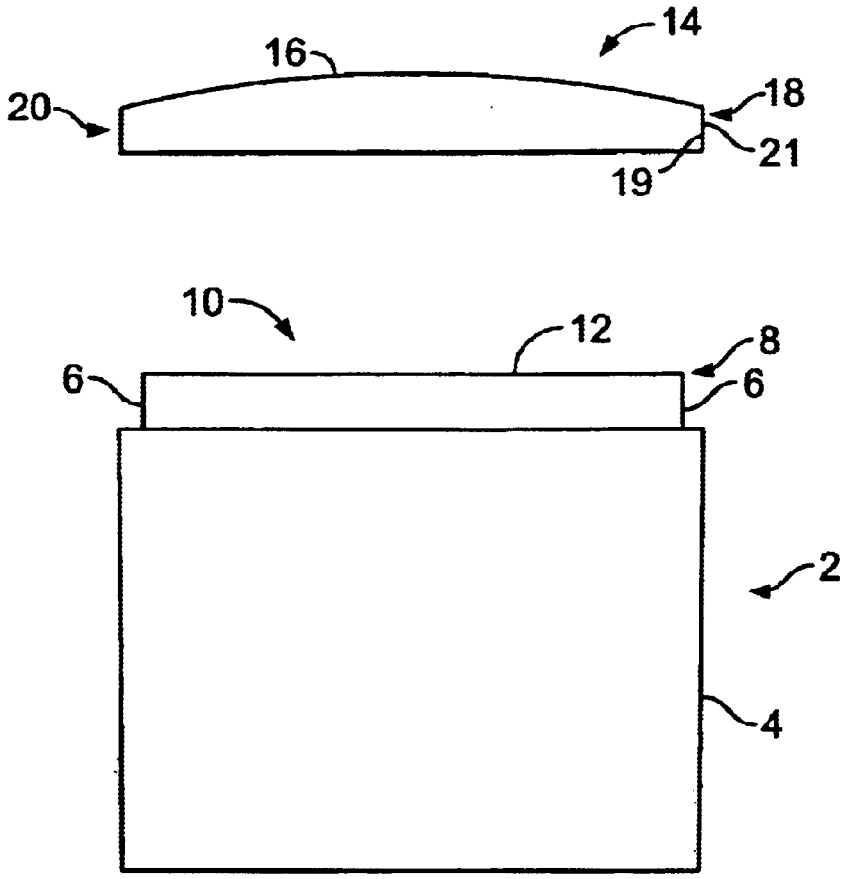
FIG. 1 is a side view of a container and closure.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention," relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

Referring now to the figures, and in particular to FIG. 1, which illustrates a typical container or packaging reservoir (2), made of a resilient yet flexible plastic material, preferably polypropylene, polyethylene or like material, however may also be made of other material such as glass or an equivalent which can readily withstand heat. The container (2) has a body (4), and resting on the body (4) of the container (2) are sidewalls (6) extending upward forming the neck (8) of the container (2). The neck (8) defines the periphery or rim (12) of the container (2) and forms the opening or mouth (10) of the container (2).

The closure, (14) may vary in shape so long as it fully encompasses the opening or mouth (10) of the packaging reservoir (2) to ensure the containment of the contents. The closure (14) can be described as having an inverted hollow cup shape with a top surface (16), and downwardly extending external sidewalls (18) forming a skirt (20). The sidewalls (18) have an inner (19) and outer (21) surface. The inner surface (19) may have ridges or knurls extending around the sidewalls (18) continuously or intermittently to facilitate securing the closure to the container by way of turning or twisting. Other securing means can be utilized with the present invention so long as the closure has a means for securing itself to the container.

Figure 2:
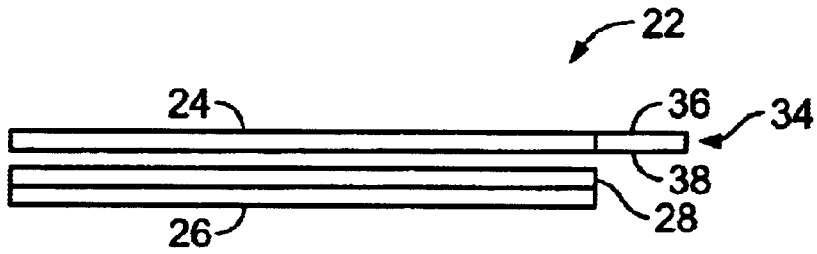
FIG. 2 is a side view of a liner incorporating a narrow pull tab or extension.
Figure 5:
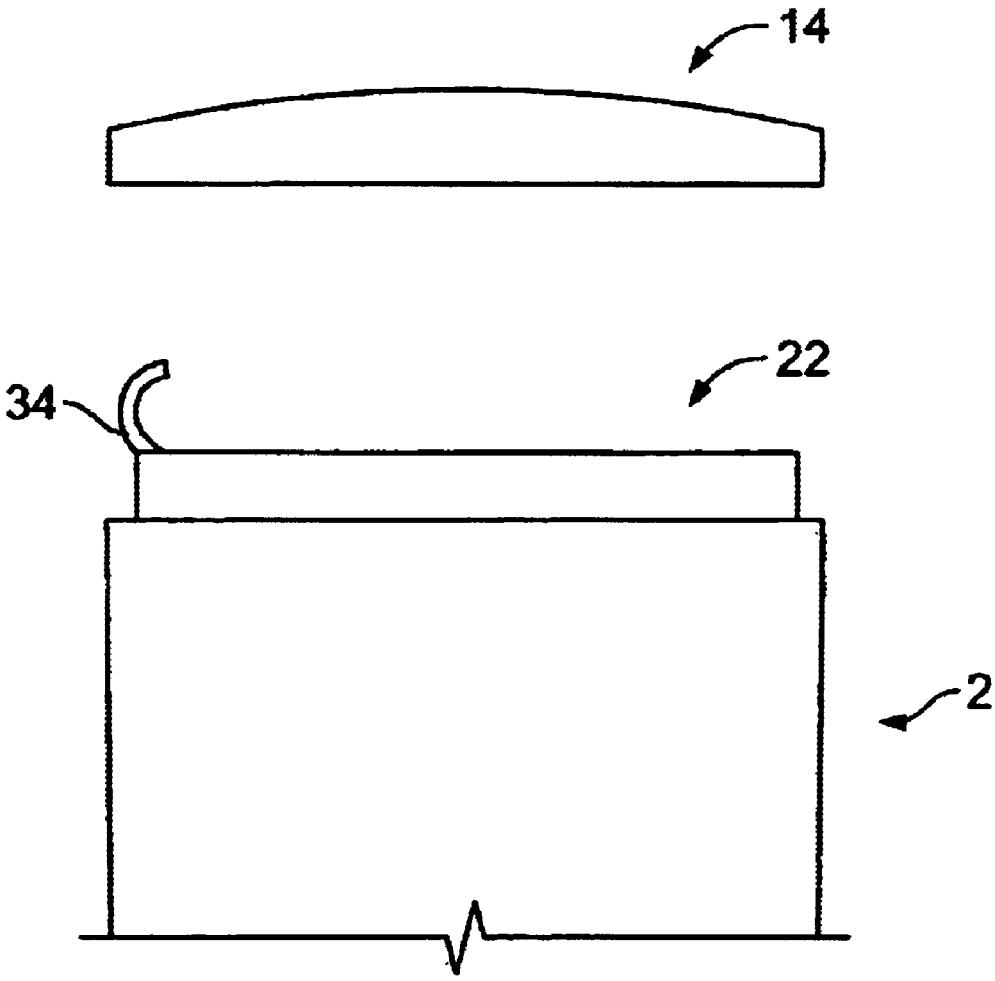
FIG. 5 is a side view of the multiple layer assembly of the closure, liner and container incorporating the narrow pull tab or extension.

FIG. 5 represents the multi layer assembly of closure, liner and container. The liner (22) is generally a packaging laminate, which may be heat sealable to a wide variety of bottle materials, such as polypropylene, high-density polyethylene or linear low density polyethylene to provide a strong peelable seal. The side or horizontal view of the innerseal or liner (22) illustrated in FIG. 2, shows the different layers encompassing the liner (22). A typical heat induction liner (22) includes a backing or top layer or sheet (24) typically made of pulp or a synthetic or polymeric material conventionally used to make closure liners, for example polyethylene, high-density polyethylene, polyethylene terephthalate, polypropylene, polystyrene, or polycarbonate plastics, a middle or foil layer (26), preferentially a metallic foil, but can be also be made of any another polymeric material so long as the material will preserve the integrity of the contents in the container (2), and a bondable or adhesive layer (28). The foil or middle layer (26) is typically heated by the induction unit, which in-turn heats the bondable or adhesion layer (28) causing minimal heating or melting of the container mouth (10) resulting in a bond between the liners and the container mouth (10). Although, the preferred embodiment of the present invention describes a liner having three layers, a top layer, a bottom layer and an adhesive layer, this liner (22) may encompass multiple layers forming the sealing membrane, and more particularly, the present invention includes an adhesion layer which need not be included to form the packaging laminate.

Figure 3:
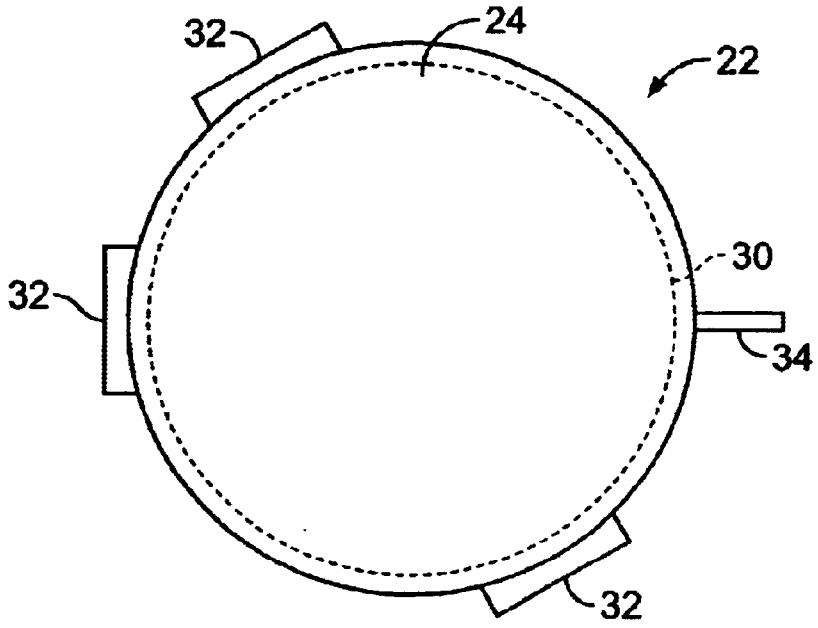
FIG. 3 is a top view of a container liner incorporating a narrow pull tab.

Depicted in FIG. 3, is the top sheet or layer (24) of the liner (22). The top sheet (24) is defined by the periphery of the sheet. The liner is hermetically sealed to the rim (12) of a container (2), best shown in FIG. 4 of the drawings, to create a seal and protect the contents of the container (2). To ensure that the lining (22) will cover and protect the contents of the container, the diameter of the liner (30) is approximately or slightly more than the width of the diameter of the container (12). Extending from the rim of the liner (30) are tabs (32), which facilitate easier removal of the liner (22) from the container (2). There may be three tabs (32) around the perimeter of the rim (30) of the liner and they may be located at equal distances around the rim (30) or may be positioned anywhere around the rim (30) to retain the liner in the closure prior to the capping operation.

Extending radially from the liner (22) is a narrow pull tab or extension (34). The extension (34) has at least two layers, a top sheet or film (36) and a bottom sheet or film (38) as shown in FIG. 1, and preferably has three layers including a middle foil layer. The width of the extension (34) is preferably from about 1/16" to 3/16", and more preferably 1/16". Particularly, the narrow pull tab is sufficiently narrow to allow breakage of the tab (34) from the skirt (20) at about a rotary torque of about 10–20 lbs/square inch, and more preferably about 15 lbs/square inch.

Figure 4:
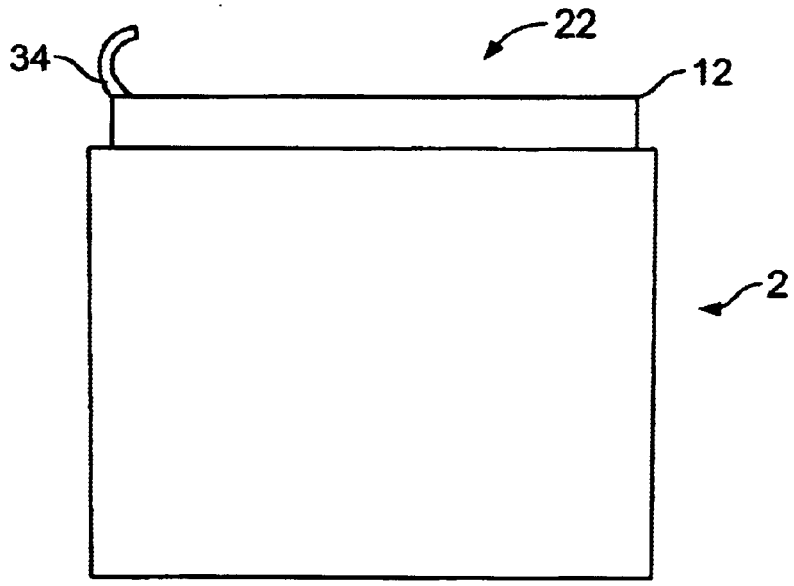
FIG. 4 is a top view of the liner incorporating a positioned narrow pull tab or extension prior to assembly.

After the packaging process the liner (20) is firmly positioned over the mouth or opening (10) of the container (2), which typically is filled with product, whereby access to the opening is prevented. The rim of the liner (30) abuts the rim of the neck of the container (12) thereby positioning the liner over the opening, (10) and allowing for the tabs to overhand the rim of the container (12). The narrow extension or pull tab (34), which also overhangs over the rim of the container (12) is folded over so as to be disposed on the perimeter of the opening of the container (10), and is formed on the underside or inner surface of the closure and engages the inner surface of the closure (14) and preferably the top surface (16) of the closure (14), forming a seal after the heating process, this is best shown in FIGS. 4 and 5. Particularly, the narrow pull tab or extension (34) is bent upward and inward toward the perimeter of the rim of the container (12) as shown in FIG. 2, at an angle of between about 0 to about 45 degrees to the plane of the liner (22).

After the liner (22) is positioned over the opening of the container (10) and the pliable narrow pull tab (34) is disposed at an angle toward the interior of the opening of the container (10) the closure (14) is secure over the container (2). The container (2) and closure (14) assembly is then subject to a process of heating. This heating step allows the adhesive in the adhesion layer (28) of the liner (22) to adhere to the rim of the container (12).

Concurrently, during this heating process, the narrow pull tab (34) which is positioned and abuts the inner surface of the closure (14), and preferably the top surface (16) of the closure (14), melts and causes the tab (34) to adhere to the closure (14) thereby preventing the closure from loosing or becoming displaced form the container (2) and thus exposing the sealed liner (22).

After the heating step, the narrow pull tab or extension (34) is sufficiently secured to the top surface (16) of the closure (14) by melting itself to the closure so that there is no loosening of the closure (14) during transport or storage; however, when sufficient force is applied, e.g. by the consumer, the closure (14) is removed from the container (2), either by twisting, lifting or other means of removing the closure (14), and the narrow pull tab or extension (34) is simultaneously disengaged or fractured from the closure (14) and removed from container (2), still leaving the sealed or bonded portion of the liner (22) undamaged and secured over the opening of the container (2). Particularly, the sufficient amount of rotary torque applied to allow the tab (34) to break away from the skirt (20) is generally dependent on the liner material, the tab width and the amount of heat used to secure the narrow pull tab (34) to the closure (14), preferably however, the rotary torque needed to disengage or fracture the pull tab (34) form the closure (14) while still leaving the liner securely sealed or bonded over the mouth (10) of the closure is between about 10–20 lbs/square inch, and more preferably about 15 lbs/square inch.

Accordingly, one aspect of the invention provides a container and closure assembly whereby a pull tab sufficiently narrow in width is secured to the interior of the closure, thereby preventing the closure from becoming loosened or displaced, yet when sufficient torque is applied by the consumer to open the closure and remove it from the container the narrow pull tab or extension is disengaged from its seal to the interior of the closure, yet having the liner over the mouth of the closure remains intact and undamaged, thus preventing any contamination of the container content.

According to a second aspect of the invention, a method for forming a sealed container with a secured closure over the container, of the type which includes a safety innerseal or liner includes the step of: providing a container body having a rim; placing an innerseal or liner over the rim of the container, whereby the opening or mouth of the container is covered; placing the narrow pull tab which overhangs the rim of the container and bending it inward toward the center of the liner so that the tab overlies the liner; placing the closure over the liner and container whereby the narrow pull tab becomes engaged with the interior of the closure; passing the container and closure through a heating station whereby the innerseal or liner is sealed onto the container body, and the narrow pull tab is sealed to the inner top surface of the closure; thereby providing a container and closure assembly which prevents the closure from becoming loosened or displaced from the container and further having a sealed container which prevents leakage of the container contents and contamination of the contents from elements outside the container, yet when sufficient force is applied to the closure the tab is disengaged from the closure and the closure is removed from the container leaving a liner in place and sealed.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A tamper resistant sealing liner and closure combination for use with an associated container comprising;

a closure having a top surface, extending from said top surface are sidewalls forming a skirt of the closure, said closure having an inner and outer surface;

a liner comprising:

at least one layer having a circumference, said liner sealable over an opening in said associated container;

a tab extending from said liner circumference and having a free edge spaced from said circumference, said tab reliably adhesively engaged with said inner surface of said closure to maintain the closure secured to said liner to thereby restrict rotation of the closure in relation to the associated container;

whereby a rotary torque applied to said closure of between about 10–20 lbs/square inch causes tearing of at least part of the tab.

2. A liner and closure combination according to claim 1, wherein said tab is adhesively engaged with said top surface of said closure.

3. A liner and closure combination according to claim 1, wherein said liner has a first layer, a second layer and a third layer.

4. A liner and closure combination according to claim 3, wherein said first layer is a top polymeric sheet.

5. A liner and closure combination according to claim 3, wherein said second layer is an adhesion layer.

6. A liner and closure combination according to claim 3, wherein said third layer is a bottom metallic sheet.

7. A liner and closure combination according to claim 1, wherein said liner has one plastic layer.

8. A liner and closure combination according to claim 1, wherein said tab is disposed inward toward the inner surface of said closure.

9. A liner and closure combination according to claim 1, wherein said tab has at least two layers.

10. A liner and closure combination according to claim 1, wherein said tab width is about between 1/16" to about 3/16".

11. A liner and closure combination according to claim 1, wherein an inner surface of said skirt has ridges.

12. A liner and closure combination according to claim 1, wherein said tab is sufficiently thin to allow said tab to break from said closure with a rotary torque of about 15 lbs/square inch.

13. A closure and liner assembly for use with a container having an opening and a closure adapted to be secured to said container comprising:

said closure including a top surface, extending down from said top surface are sidewalls forming a skirt of the closure, the closure having an inner surface;

said liner having at least one layer having a diameter, and consistently having a tab extending from said liner and adhesively affixed to said inner surface of said closure to thereby restrict rotation of said closure in relation to said container;

said tab having a width so that by a radial movement of the closure with a torque of about 10–20 lbs/square inch whereby the tab tears to provide a visual indication of removal of the closure from the container.

14. A closure and liner assembly of claim 13, wherein said tab extending from said liner is integral with said top surface of said closure.

15. A closure and liner assembly of claim 13, wherein by the radial movement of the closure causing the tab to fracture.

16. A closure and liner assembly of claim 13, wherein by the radial movement of the closure causing the tab to break from the closure.

17. A closure and liner assembly of claim 13, wherein the width of the tab is about between 1/16" to about 3/16".

18. A closure and liner assembly of claim 13, wherein the torque is of about 15 lbs/square inch.

* * * * *